US006029705A

United States Patent [19]

Happe

[11] Patent Number: 6,029,705

[45] Date of Patent: Feb. 29, 2000

[54] GAS CONTROL VALVE

[75] Inventor: Barbara Happe, Gernrode, Germany

[73] Assignee: Mertik Maxitrol GmbH & Co., KG, Germany

[21] Appl. No.: 09/038,864

[22] Filed: Mar. 11, 1998

[30] Foreign Application Priority Data

Oct. 23, 1997 [DE] Germany ..... 197 46 788

[51] Int. Cl.[7] ..... F16K 11/18

[52] U.S. Cl. ..... 137/630.19; 251/129.19; 137/628; 137/614.11; 137/614.19

[58] Field of Search ..... 251/129.19; 137/630.19, 137/628, 629, 883, 614.11, 614.19

[56] References Cited

U.S. PATENT DOCUMENTS

| | | | |
|---|---|---|---|
| 2,228,198 | 1/1941 | Cerny | 137/630.19 X |
| 4,729,396 | 3/1988 | Kelly et al. | 137/630.19 X |
| 5,209,455 | 5/1993 | Uetsuhara et al. | 251/129.19 |

*Primary Examiner*—Denise L. Ferensic
*Assistant Examiner*—Joanne Y. Kim
*Attorney, Agent, or Firm*—Harness, Dickey & Pierce, P.L.C.

[57] ABSTRACT

A gas control valve is disclosed which enables a variable adjustment of the gas flows. Furthermore, a remote control may be utilized in conjunction with the gas control valve. The manufacturing expense and the size is kept at the lowest possible minimum. The main valve in the casing is followed by a switch which is known per se and equipped with a springy element and which, in conjunction with two valves, enables a modulating control with jerk-like on/off switching in the partial load range. This switch can be actuated by a tappet which is movable in longitudinal direction and projects beyond the gas-bearing casing to the outside and whose position can be changed by means of an operating element. The operating element can be actuated manually and/or via a driving unit in the form of an electrically driven motor coupled with a battery. The gas control valve for a gas-heated fireplace or similar installation serves the largest possible manipulation of the visible flames, in particular for decorative reasons.

12 Claims, 4 Drawing Sheets

GAS CONTROL VALVE

BACKGROUND AND SUMMARY OF THE INVENTION

The present invention relates generally to gas control valves and more specifically to gas control valves for gas-fired fireplaces or similar installations.

Gas control valves for gas stoves or similar installations are available in a large variety of designs. Said valves are employed to control the gas flow which fuels the burner. For decorative reasons, it is desirable to be able to control the visible flame in fireplaces. It is due to the fitting position of said gas control valves, which is rather unfavorable for frequent adjustment in most of the cases, that as a rule a separate switch is used to switch the main burner on and off.

A solution in which the main burner is switched on and off by means of a separate switch is described in EP 0 635 680 A1, albeit that this option employs a temperature controlled switch. The underlying principle is that the energy captured from the ignition flame by a second thermoelement is employed to regulate a second control valve. The latter control valve opens and shuts off the gas supply of the main burner. In order to do so the above-mentioned thermal switch will either make or break the circuit. Another opportunity, as illustrated in FIG. 2 of the aforementioned European patent application, is to adjust the gas volume by using an electromagnet which actuates a pressure governor.

The disadvantage that is inherent in the solutions described above is the second control valve can only be in two positions, either open or closed. They fail to enable a variable adjustment of the gas volume which flows to the main burner.

Another commonly known fact is that the gas volume which flows to the main burner may be controlled by a DC magnet that actuates on a pressure controller. This solution facilitates the variable adjustment of the gas volume.

However, the disadvantage here is that the required performance parameters of the DC magnet and the fact that each operating state requires electrical energy, make a power supply and additional components necessary, such as rectifiers and transformers.

A further solution is known from electrically-driven gas control devices. There a number of solenoid valves are employed and make on/off positions but also intermediate positions possible.

However, their disadvantage is that they require a power supply as indicated for the solution described further above. To this adds the fact that a power failure prevents operation of the gas-heated fireplace or similar installation.

The present invention is based on the problem of developing a gas control valve of the described kind which facilitates the variable adjustment of the gas volume. In particular, the use of a remote control device shall be facilitated for this purpose. The manufacturing expenditure and the size of the valve shall be kept as small as possible.

The present inventors have found that the problems of the prior art can be addressed by arranging a first valve effecting a stepwise switching on and off and a second valve effecting a modulating control in the casing downstream of the flow path of the gas stream for the main burner, with the valves being controllable jointly by a switch which is biased by a spring element in such a way, that the first valve opens in a jerk-like fashion upon the initial actuation of the switch and, upon the further adjustment of the switch, the second valve is opened progressively. The switch can be actuated by a longitudinally moving tappet which projects from the casing to the outside and whose position can be changed via an operating element. The operating element can be actuated manually and/or via a driving unit in the form of a battery-operated, electrically driven motor.

Thus a solution has been found which removes the disadvantage of the prior art, i.e., a switch without power supply was unable to implement a variable adjustment of the gas volume. The fact that now power is only required when the gas volume shall be adjusted by means of the motor makes it possible to employ a battery, under consideration of a reasonable service life. Further distinguishing features of this solution are its simplicity and its small size.

Confer the other patent claims for further advantageous features of the present invention. What proves to be particularly advantageous is that the axially shiftable operating element is equipped with a radially arranged toothing into which the motor catches via a transmission gear. The rotating motion is limited by stoppers on the casing. A sliding clutch is provided between the driving unit and the operating element in order to prevent overloading of the motor.

In order to optimize the moving range for the adjustment of the gas volume flowing to the main burner, and hence the flame height, it is favorable if the resilient element, which is located between the operating and the tappet, consists of at least two spring elements, with the spring constant of the one spring element being chosen in such a way that it matches the block length when the switching path of the switch is in the range of the jerking switch on/off option. However, when the switching path of the switch is in the modulating control range, both spring elements are in their resilient range. A very simple design can be chosen when the two spring elements consist each of one or more disk springs.

Subsequently, a practical example is given to describe the invention in greater detail.

DESCRIPTION OF THE PREFERRED EMBODIMENT

Figure 1:
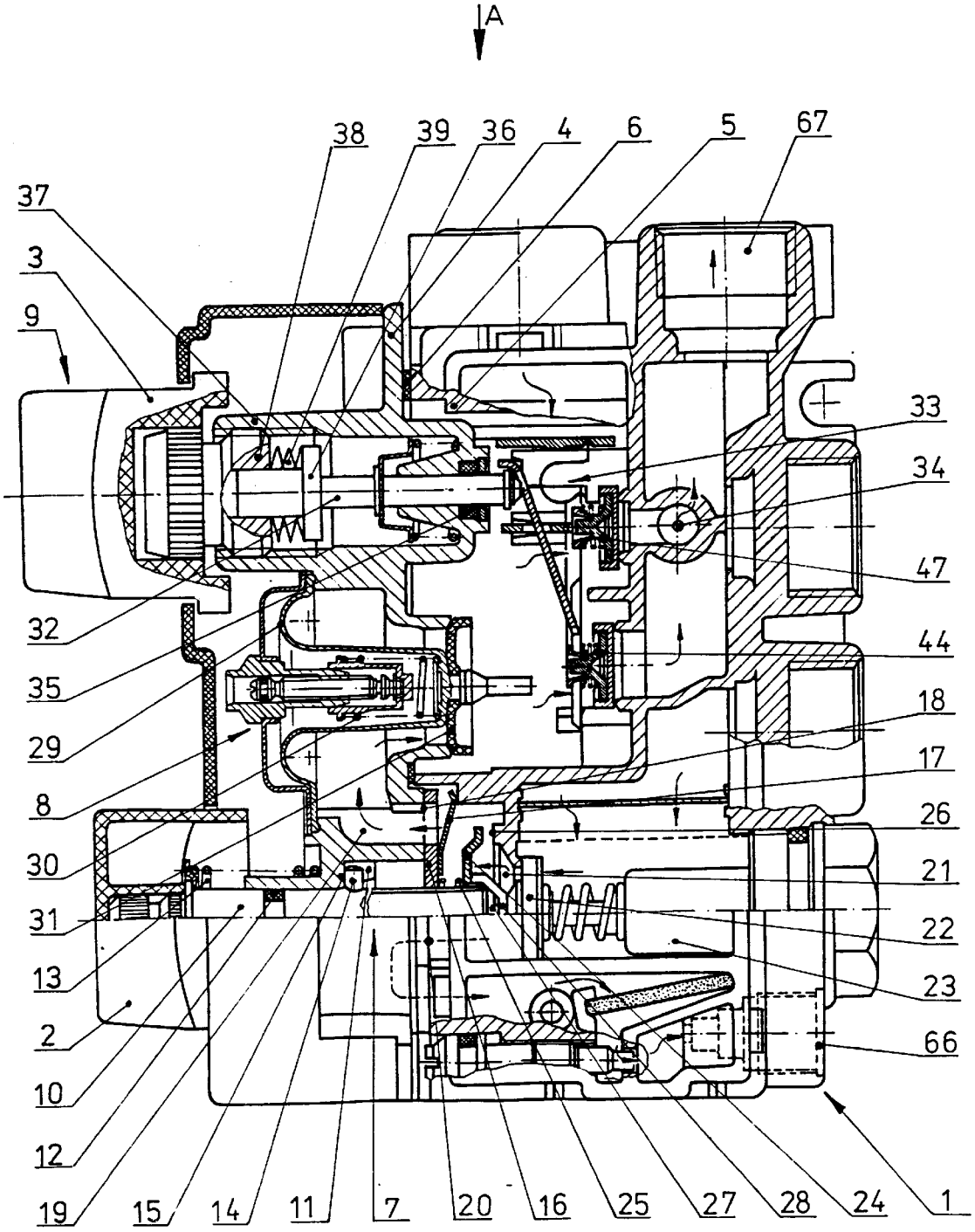
FIG. 1 a sectional view of a gas control valve according to the invention.

The gas control valve according to the invention as exemplary depicted in FIG. 1 is a switch and control device which is preferably designated for installation into a gas-heated fireplace or a similar installation. It facilitates the operation and supervision of the burner, as well as pressure control and the adjustment of the flame height by regulating the gas volume flowing to the main burner.

This gas control valve consists of a casing 1, made of aluminum diecasting, which houses the individual functional units, part of which can be actuated from outside by means of operating elements 2 and/or 3. The casing 1 is composed of an upper part 4 and a bottom part 5, with a flat packing 6 in between which safeguards the external tightness. The position of the point of separation may not be chosen optionally but depends on the design of the functional units.

The gas control valve accommodates the following functional units:

starting device 7 with safety pilot and restarting lock pressure governor 8 control unit 9 for the gas volume flowing to the main burner

For the starting device 7 an actuating rod 10 runs rotatably on a bearing in the top part 4 and is also lengthwise movable, depending on a guide profile 11, with the required gas tightness being safeguarded, for instance, by an 0 ring 12. The starting device is actuated manually by means of the operating element 2 which is firmly connected to the actuating rod 10. Thus the movement in longitudinal direction is only possible against the power exerted by a recuperating spring 13 which is supported by the upper part 4. The initial position, which is enforced by the power of the recuperating spring 13, is achieved by a transverse pin 14 which is press-fitted into the actuating rod 10, said pin is located in the casing 1 interior and, in the initial position, sits close to a stopper 15 in the upper part 4. The end part of the actuating rod 10 reaches into the interior of the bottom part 5.

A rotary slide 16, which forms the main valve, is led in the direction of rotation on the actuating rod 10 in connection with openings 19/20 which are described below; said slide is pressed by a stirrup spring 17 against a sealing surface 18 which has one opening 19 for the main flow and one opening 20 for the ignition gas flow.

The guide profile 11, described above, is formed to cooperate with pin 14 in such a way that the actuating rod 10 can only then be moved in its longitudinal direction when, due to the position of the rotary slide 16, only opening 20 for the ignition gas flow is opened, with the minimum size of the opening cross section being dimensioned in such a way that the ignition gas volume can pass through which is required for the ignition of the unit.

The bottom part 5 is laid out with an aperture 21, which is in alignment with the rotary slide 16 and thus in prolongation of the actuating rod 10, which forms part of a safety pilot valve 22. Said safety pilot valve 22 is affected by a thermoelectrical safety pilot magnet 23 which is located in a bearing of the bottom part 5 in a gas-tight manner.

The part of the actuating rod 10 which projects into the bottom part 5 is equipped with a stirrup 24 that can be freely moved in the longitudinal direction of the actuating rod 10 but is led through the actuating rod 10 in the direction of rotation and is loaded in the direction towards the safety pilot valve 22 by a spring 25 supported by the rotary slide 16. The gliding surface 26 formed in the bottom part 5 by the rotary motion of the stirrup 24 is interrupted by a groove 27 which, due to the action of the spring 25, accommodates the end parts of the stirrup 24, when the openings 19/20 for the main gas flow in the upper part 4 are closed by the rotary slide 16 and simultaneously the safety pilot valve 22 is in opened position.

Furthermore, the stirrup 24 is equipped with a tongue 28 that projects in axial direction to the safety pilot valve 22 and whose length is dimensioned in such a way that, upon closed safety pilot valve 22 and closed openings 19/20, the two end parts of the stirrup 24 are located outside of the groove 27.

The mode of action of the restarting lock is as follows: When the ignition gas flow shall be ignited the actuating rod 10 is turned with the operating element 2 until the opening 20 in the upper part 4 is sufficiently opened to let the ignition gas flow pass, while the opening 19 for the main gas flow is closed. Simultaneously, the locking feature provided by guide profile 11 prevents further rotation of actuating rod 10 but allows rod 10 to be axially pressed down. Subsequently the actuating rod 10 is pushed in thereby opening the safety pilot valve 22. As illustrated in FIG. 1 by the arrows indicating the flow, the gas flows via the gas inlet 65 through the opened safety pilot valve 22. The ignition gas flows through the opened opening 20 and via the ignition outlet 66 to the pilot burner, which is not depicted here, and can be ignited. The safety pilot valve 22 will remain in its position after the operating handle 2 is released after a certain period of time following the excitation of the safety pilot magnet 23 by a thermocouple, and only the actuating rod 10 slides upwards. Thus a position is achieved in which only the ignition flame burns and which, in technical terms, is commonly called "readiness for service" position.

A further turning of the operating element 2 will then open the opening 19 for the main gas flow until the maximum opening cross section is arrived at which will be signalled by a stopper—thus the so-called "service" position is achieved. It goes without saying that the further turning of the operating element 2 into the "operating position" will prevent pressing down of the actuating rod 10 by the guide profile 11 mentioned above.

When the fireplace is switched off, by turning the operating element 2 of the gas control valve back into initial position, which is also signalled by a stopper, both the opening 19 for the main gas flow and the opening 20 for the ignition gas flow are closed by the rotary slide 16. It is due to the safety pilot valve 22 still being opened, since it is excited, that the two ends of the stirrup 24 fall into the groove 27, hence preventing a turning of the actuating rod 10 and thus a re-opening of the opening 19 for the main gas flow by the rotary slide 16. It is only after the safety pilot magnet 23 ceases to be excited that the safety pilot valve 22 is closed and the two end parts of the stirrup 24 are moved from the groove 27 by the tongue 28, so that the unit can be ignited again.

The pressure governor 8 is located behind the starting device in the direction of flow. The pressure governor 8 consists of a membrane 29 which is fixed along its perimeter in a gas-tight manner, whose pot-like part is equipped with a compression spring 30 that can be adjusted from the outside and counteracts the gas pressure behind the valve disk 31 which is fastened to the front of the pot-like part of the membrane that projects into the casing 1. The adjustment of the pressure governor 8 is dependant on the gas type used.

Figure 3:
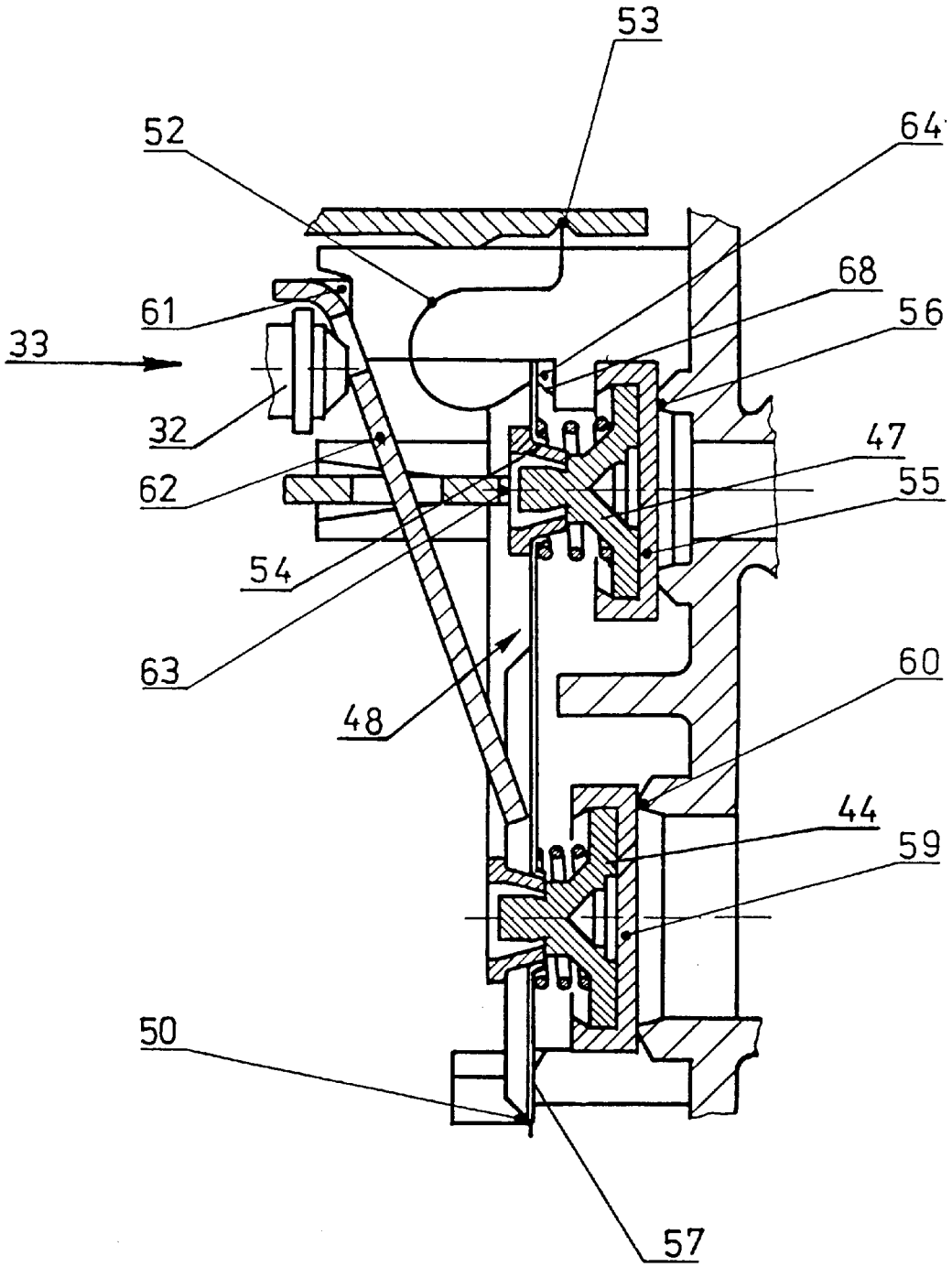
FIG. 3 a sectional, enlarged view of a switch of a gas control valve according to the invention.
Figure 4:
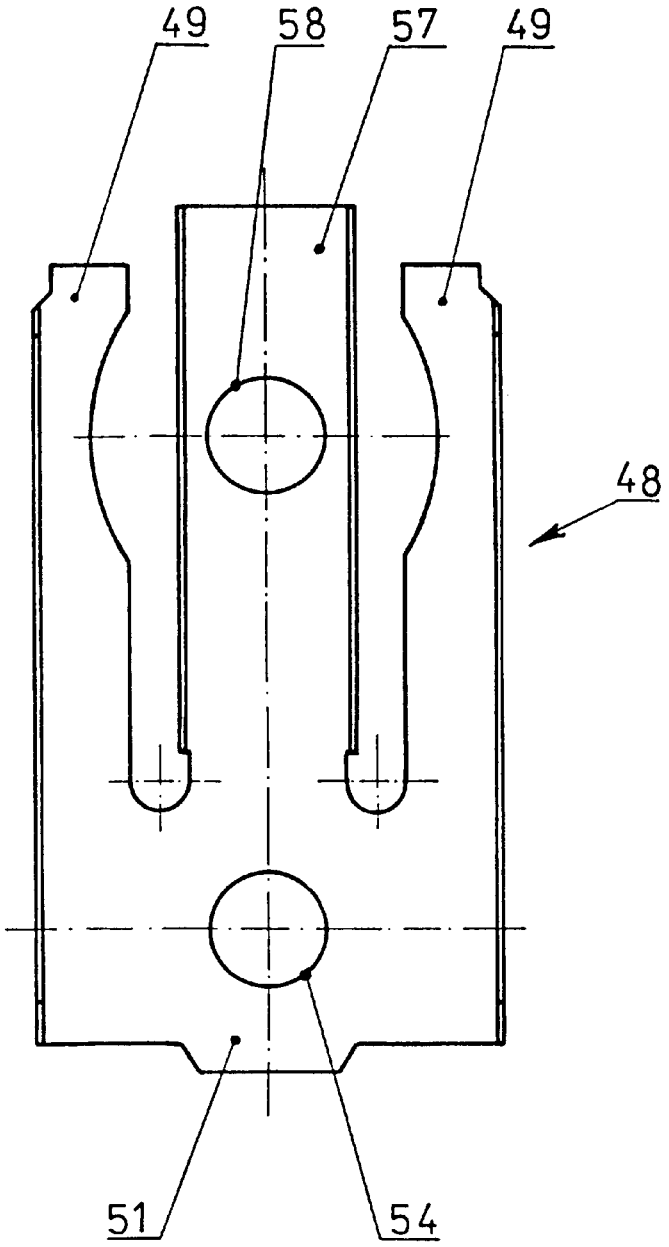
FIG. 4 an enlarged view of a fly spring from a gas control valve according to the invention.

A switch 33 (FIG. 3) is located next to the pressure governor in the casing 1. Said switch 33 is equipped with a double slotted fly spring 48, as illustrated in FIG. 4, which, on the one hand, is supported by its two outer ends 49, situated at the slotted part, in a first bearing 50 located in the casing 1; while, on the other hand, its non-slotted side 51 is connected to a lyrate spring 52 which is supported by a second bearing 53 also located in the casing 1. A so-called first valve closer body 55 which is assigned to the first valve 47 is supported by a first guide boring 54 at the side 51 facing the lyrate spring 52, a first valve seat 56, situated in the bottom part 5, is assigned to said body. In addition, a second valve closer body 59, to which a second valve seat 60—located in the bottom part 5—is assigned, is situated on a springy tongue 57 between the two outer ends 49 of the fly spring 48 and supported in a second guide boring 58, said body is assigned to the second valve 44 and a second valve seat 60, located in the bottom part 5. A lever 62, which is supported by a third bearing 61 located in the bottom part 5 is impinged on by the tappet 32 and acts upon the tongue 57 of the fly spring 48 with its other end. Lever 62 is supported by third bearing 61 such that absent any biasing action by tappet 32 it will assume a position more closely approximate a position lying in a plane substantially perpendicular to the longitudinal axis of tappet 32. As shown tappet 32 engages lever 62 and urges it toward and into engagement with springy tongue 57 of fly spring 48.

The stroke of the switch 33 is determined by the stoppers 63/64 which limit the movement of the fly spring 48.

Springy tongue 57 is formed such that absent any external forces it will assume a position such that valve closer body 59 will be spaced from valve seat 60 a maximum distance. As noted above, lever 62 will be forced downwardly by tappet 32 so as to urge valve closer body 59 into sealing engagement with valve seat 60. Likewise, absent external forces exerted on fly spring 48, lyrate spring 52 will operate to bias valve closer body 55 upwardly into engagement with stopper 63. Again the biasing force exerted on fly spring 48 by lever 62 under the influence of tappet 32 will cause valve closure body 55 to be moved into and retained in sealing engagement with valve seat 56.

The switch 33 is designed such that initial longitudinal movement of tappet 32 in a direction away from lyrate spring 52 will reduce the force applied by lever 62 on fly spring 48 sufficiently that lyrate spring 52 will cause valve closure body 55 to move rapidly upwardly in a jerk like opening movement into engagement with stopper 63 thereby opening valve 47. Thereafter continued longitudinal movement of tappet 32 will further reduce the biasing force exerted by lever 62 on fly spring 48 thereby enabling springy tongue 57 to move valve closure body 59 out of engagement with valve seat 60. The degree of opening of valve 44 will operate to modulate the flow of gas therethrough while valve 47 will remain in a fully open position to provide a sufficient gas flow to maintain operation of the main burner.

The switch 33 is designed in such a manner that a modulating control via the valve 44 is effected with jerk-like on/off switching in the partial load range via valve 47. The partial load through-flow is limited by an adjustable nozzle 34.

The tappet 32, which is in non-positive connection with the switch 33 and movable in a longitudinal direction projects from the upper part 4 of the gas bearing casing 1 which simultaneously forms its bearing. An O ring 35 may be used, for instance, to provide the necessary external gas tightness. The end of the tappet 32 which is opposite to the switch 33 is supported by an intermediate piece 36, which is located in a tubular shaped top 37 connected in one piece to the upper part 5. The side of the intermediate piece 36 opposite the tappet 32 is equipped with a peg-shaped extension which, on the one hand, serves to receive a springy element—described in greater detail below—and, on the other, is longitudinally movably led in a thrust piece 38 which in turn is threadedly connected to upper part 4 in the interior of the top 37. The thrust piece 38, for its part, is firmly connected to the operating element 3 by pressing it in, for instance. A stopper such as for example a snap ring is mounted to the top 37 and serves to limit the rotation movement of the operating element 3, in conjunction with the relevant shaping of the operating element 3.

In this present practical example the springy element consists of five disk springs 39, with the spring constant of one disk spring 39 being specified in such a way that this disk spring 39 is depressed to a maximum, i.e., is at block length, when the switch path of the switch 33 is the range of the jerk-like on/off switching. However, all disk springs 39 are in their springy range when the switch path of the switch 33 is in the modulating control range. That is to say that as operating element 3 is rotated toward an open or service position from a position in which valves 44 and 47 are both seated on respective valve seats 60 and 56, the biasing action exerted by tapper 32 on lever 62 will be reduced to the point that the biasing force exerted by lyrate spring 52 will cause springy tongue 57 and tappet 32 to move radially upwardly compressing the weakest or softest of disk springs 39. This action allows valve 47 to move into an open position in a jerk-like manner. Similarly, as operating element 3 is rotated into a closed position, the biasing action of the softest disk spring will reach a point at which its forces exceeds the opposing force of lyrate spring 52, and valve 47 will move to a closed position in a jerk-like manner. The benefit of the "softer" disk spring 39 is that the setting range is enlarged which makes possible a more sensitive adjustment.

Figure 2:
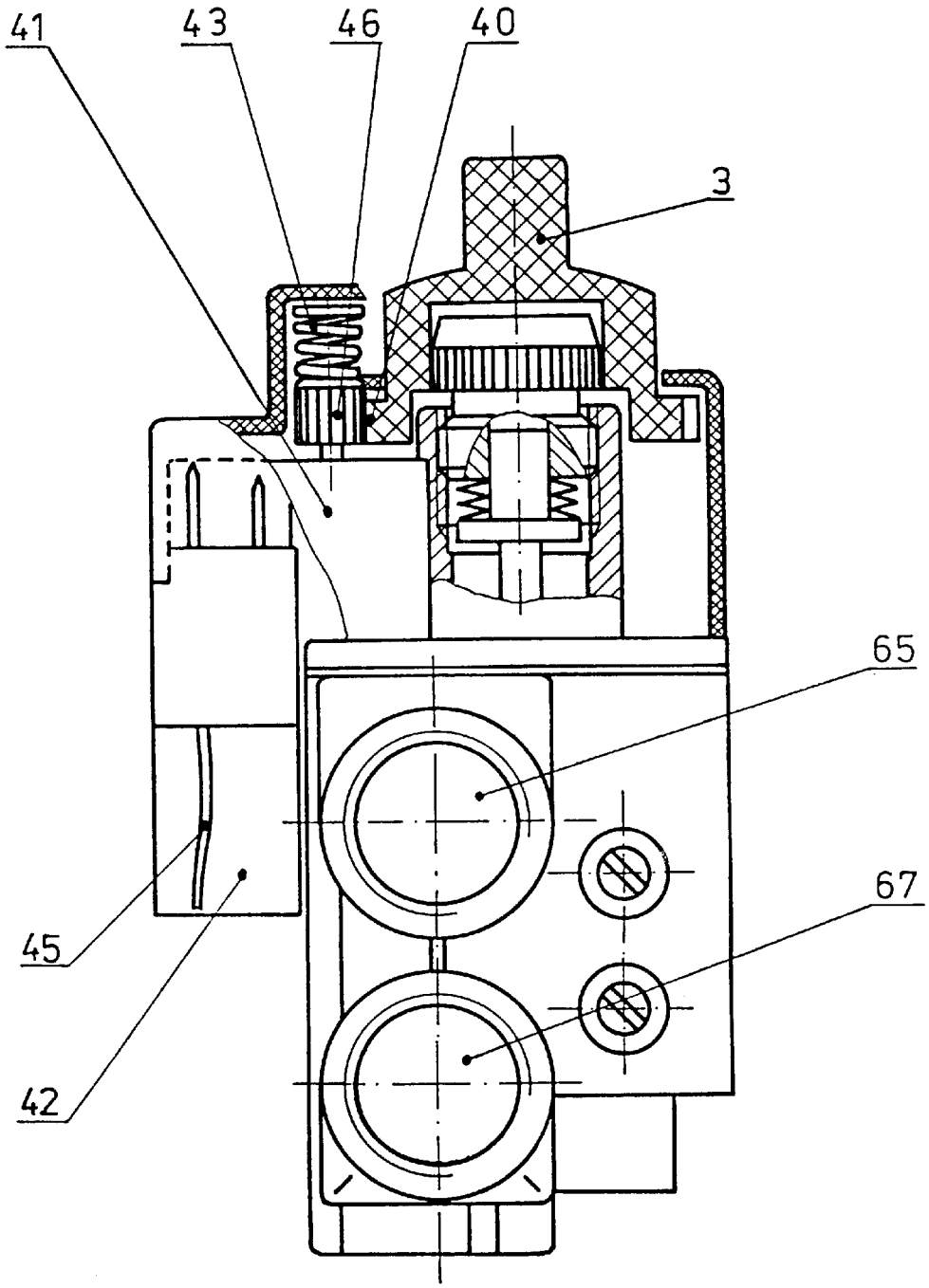
FIG. 2 a view of a gas control valve according to the invention taken in the direction of arrow A in FIG. 1 with portions thereof broken away.

As shown in FIG. 2, the external perimeter of the operating element 3 is equipped with toothing 40 into which a pinion 46 catches that forms part of a transmission gear 41. The transmission gear is coupled with a driving unit 42 fastened to the casing 1 and consists of an electrical motor and a battery. A sliding clutch 43 is arranged between the driving unit 42 and the operating element 3, its purpose is the prevention of a motor overloading. It is commonly known among technical experts and, hence, not further explained.

The motor is connected by a distributing cable 45 to a switch or push-button, of a commercially available type and hence not depicted here, to facilitate switching on and off and the selection of the direction of rotation.

The mode of action of the control unit 9 for the gas volume flowing to the main burner is explained below:

The main gas flow—as indicated by the flow arrows in FIG. 1—flows through the opening 19 and the pressure governor 8 to the switch 33, following the ignition of the ignition gas flow by means of the operating element 2, as described in great detail above and the established "readiness for service" position. In the event that the operating element 3 is in minimum position, as limited by the stopper located on the top 37, the switch 33 is closed and the main burner is out of operation. Now, if a flame shall become visible with a requested height in a fireplace or similar installation, in particular for decorative reasons, the motor is operated by the pushbutton or switch which is connected to the drive unit 42 via the distributing cable 45, thus the pinion 46 of the transmission gear 41 generates a rotating movement of the operating element 3 which, via the thrust piece 38, disk springs 39 and intermediate piece 36, is translated into a longitudinal movement of the tappet 32 which acts upon the switch 33.

The longitudinal movement of the tappet 32 enables a rotating movement of the lever 62 supported in the bearing 61. While the valve 44 remains closed by the tongue 57, the lyrate spring 52 triggers a jerk-like lifting of the valve closer body 55 from the valve seat 56. The constant gas volume, limited by the nozzle 34, flows through the gas outlet 67 and into the main burner and is ignited by the ignition flame. The flames are burning at minimum height. A further actuation of the push-button or switch continues the rotating movement of the operating element 3 and evenly enlarges the flame height since the tongue 57 is now allowed to move by the movement of lever 62 in such a manner that the valve closer body 59 is lifted from the valve seat which results in an even increase of gas volume flowing through the valve 44. Now the switch 33 is in the modulating range and the valve 44 is evenly opened until the rotating movement of the operating element 3 is limited by the stopper located at the top 37. Then the maximum flame height is achieved. If the push-button or switch is operated further towards increasing the height of the flame the gliding clutch 43 responds.

It goes without saying, that the height of the flame can also be adjusted manually by operating the operating element 3 in place of using the remote control.

I claim:

1. A gas control valve for a gas-heated fireplace with a thermostatic safety pilot valve and a manually operated main valve, which in conjunction serve both as safety pilots and for the separation of the gas flow into shares for a main burner and an ignition burner of the gas-heater fireplace and which are accommodated in a casing characterized by the following set-up:

a first valve (47) that triggers a jerk-like on/off switching of gas flow and a second valve (44) that brings about a modulating control of gas flow, are located in the casing (1) downstream from the main valve (16–20) and in the flow path for the main burner, with said first and second valves being laid out so that they can be controlled jointly by a switch (33) which is biased by a resilient element (39) in such a way that, upon an initial actuation of the switch (33), the first valve (47) opens in a jerk-like fashion and, upon a further adjustment of the switch (33), the second valve (44) opens continually, and that the switch (33) can be actuated by a tappet (32) which is movable in longitudinal direction and projects beyond the casing (1) to the outside and whose length may be changed by means of an operating element (3) which in turn may be operated both manually or by means of a driving unit (42) in the form of a battery-powered, electrically driven motor.

2. A gas control valve for a gas-heated fireplace according to claim 1, characterized by the feature that operating element (3) can be shifted axially and rotatable, said rotating movements are limited by stoppers located in the casing (1) and said operating element being equipped with a radially arranged toothing (40) into which the driving unit (42) catches via a transmission gear (41), and that a sliding clutch (43) is situated by the driving unit (42) and the operating element (3).

3. A gas control valve for a gas-heated fireplace according to claim 1, characterized by the feature that the resilient element consists of at least two spring elements (39) with the spring constant of the one spring element (39) being designed in such a way that it assumes a block length when a switch path of the switch (33) is in a range of the jerk-like on/off switching, while the two spring elements (39) are in a springy range when the switch path of the switch (33) is in the range of the modulating control.

4. A gas valve combination for a gas-heated fireplace according to claim 3, characterized by the feature that the two spring elements (39) consist each of one or more disk springs (39).

5. A gas valve combination for a gas-heated fireplace according to claim 1, characterized by the feature that the two spring elements (39) consist each of one or more disk springs (39).

6. A gas control valve for controlling gas flow to a burner comprising:

a housing;

a first valve member disposed within said housing movable between a first position in which said valve prevents flow of gas to said burner and a second position in which said first valve allows a predetermined volume of gas flow to said burner;

a second valve member disposed within said housing, said second valve being movable to continuously vary the volume of gas flow to said burner from said first predetermined volume up to a second predetermined volume;

an operating element extending outwardly from said housing, said operating element being operable to effect movement of said first and second valve members; and an electric drive motor for operating said operating element whereby said second valve member may be positioned at will so as to set said volume of gas flow to said burner at any volume between said first and second predetermined volume.

7. A gas control valve for controlling gas flow to a burner as set forth in claim 6 wherein said second valve moves from a closed position to a modulating position after said first valve moves to said second position.

8. A gas control valve for controlling gas flow to a burner as set forth in claim 6 wherein said predetermined volume of gas flow is substantially a minimum volume necessary to maintain combustion at said burner.

9. A gas control valve for controlling gas flow to a burner as set forth in claim 6 wherein said first valve is moved between said first and second positions in a rapid jerk-like manner.

10. A gas control valve for controlling gas flow to a burner as set forth in claim 6 wherein said drive motor is powered by a battery.

11. A gas control valve for a gas-heated fireplace with a thermostatic safety pilot valve and a manually operated main valve, which in conjunction serve both as safety pilots and for the separation of the gas flow into shares for a main burner and an ignition burner of the gas-heater fireplace and which are accommodated in a casing characterized by the following set-up:

a first valve (47) that triggers a jerk-like on/off switching of gas flow and a second valve (44) that brings about a modulating control of gas flow, are located in the casing (1) downstream from the main valve (16–20) and in the flow path for the main burner, with said first and second valves being laid out so that they can be controlled jointly by a switch (33) which is biased by a springy element (39) in such a way that, upon an initial actuation of the switch (33), the first valve (47) opens in a jerk-like fashion and, upon a further adjustment of the switch (33), the second valve (44) opens continually, and that the switch (33) can be actuated by a tappet (32) which is movable in longitudinal direction and projects beyond the casing (1) to the outside and whose length may be changed by means of an operating element (3) which in turn may be operated both manually and by means of a driving unit (42) in the form of a battery-powered, electrically driven motor, said operating element (3) can be shifted axially and rotatably, said rotating movements being limited by stoppers located in the casing (1) and said operating element being equipped with a radially arranged toothing (40) into which the driving unit (42) catches via a transmission gear (41), and that a sliding clutch (43) is situated between the driving unit (42) and the operating element (3).

12. A gas control valve for a gas-heated fireplace according to claim 11, characterized by the feature that the resilient element consists of at least two spring elements (39) with the spring constant of the one spring element (39) being designed in such a way that it assumes the block length when the switch path of the switch (33) is in the range of the jerk-like on/off switching, while the two spring elements (39) are in their springy range when the switch path of the switch (33) is in the range of the modulating control.

* * * * *

UNITED STATES PATENT AND TRADEMARK OFFICE

CERTIFICATE OF CORRECTION

PATENT NO. : 6,029,705
DATED : February 29, 2000
INVENTOR(S) : Barbara Happe

It is certified that error appears in the above-identified patent and that said Letters Patent is hereby corrected as shown below:

Column 3,
Line 10 "0" should be -- O --.

Column 7, claim 2,
Line 28, "rotatable" should be -- rotatably --.

Signed and Sealed this

Ninth Day of April, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,029,705
DATED : February 29, 2000
INVENTOR(S) : Barbara Happe

It is certified that error appears in the above-identified patent and that said Letters Patent is hereby corrected as shown below:

Title page,
Item [56], References Cited, insert the following heading and information
-- FOREIGN PATENT DOCUMENTS --
-- 0 635 680 A1 1-1995 EPO --

Signed and Sealed this

Third Day of December, 2002

JAMES E. ROGAN
*Director of the United States Patent and Trademark Office*